US008800814B2

(12) United States Patent
Braun et al.

(10) Patent No.: US 8,800,814 B2
(45) Date of Patent: Aug. 12, 2014

(54) FLUID POUCH DISPENSING CONTAINER, COOLER AND SUPPORT

(76) Inventors: Cathy Braun, Houston, TX (US); Holly Jenkins, Helotes, TX (US)

( * ) Notice: Subject to any disclaimer, the term of this patent is extended or adjusted under 35 U.S.C. 154(b) by 78 days.

(21) Appl. No.: 13/484,327

(22) Filed: May 31, 2012

(65) Prior Publication Data

US 2012/0305595 A1 Dec. 6, 2012

Related U.S. Application Data

(60) Provisional application No. 61/491,414, filed on May 31, 2011.

(51) Int. Cl.
*B65D 35/56* (2006.01)

(52) U.S. Cl.
USPC ..... 222/105; 222/108; 222/131; 222/146.6; 222/183; 222/185.1; 62/389

(58) Field of Classification Search
USPC ..... 222/95, 105, 108, 129.1, 131, 183, 222/185.1, 146.6, 325–327, 386; 62/389, 62/391, 395, 398, 400, 457.1
See application file for complete search history.

(56) References Cited

U.S. PATENT DOCUMENTS

| | | | | |
|---|---|---|---|---|
| 2,659,517 | A * | 11/1953 | Reinhardt, Jr. | 222/82 |
| 3,627,399 | A * | 12/1971 | Addison et al. | 312/241 |
| 4,105,139 | A | 8/1978 | Scholle | |
| 4,812,054 | A | 3/1989 | Kirkendall | |
| 5,096,092 | A * | 3/1992 | Devine | 222/95 |
| 5,150,520 | A * | 9/1992 | DeRisi | 29/890.043 |
| 5,377,878 | A * | 1/1995 | Rainey et al. | 222/146.6 |
| 5,444,992 | A * | 8/1995 | Bell | 62/372 |
| 5,564,601 | A * | 10/1996 | Cleland et al. | 222/129.1 |
| 6,155,461 | A * | 12/2000 | Ishihara et al. | 222/146.6 |
| 6,269,653 | B1 | 8/2001 | Katusa | |
| 6,334,329 | B1 | 1/2002 | Weller | |
| 6,658,857 | B1 | 12/2003 | George | |
| 6,789,707 | B2 * | 9/2004 | Wright | 222/326 |
| 7,464,567 | B1 | 12/2008 | Crossley | |
| 7,587,974 | B2 * | 9/2009 | Cohen et al. | 99/509 |
| 7,971,857 | B1 * | 7/2011 | Mazza | 261/30 |
| 8,002,146 | B2 * | 8/2011 | Cahen et al. | 222/108 |
| 8,056,763 | B2 * | 11/2011 | Cook et al. | 222/105 |
| 8,152,024 | B2 * | 4/2012 | Njaastad et al. | 222/108 |
| 8,313,007 | B2 * | 11/2012 | Kpabar | 222/108 |
| 8,459,503 | B2 * | 6/2013 | Groesbeck | 222/105 |
| 2007/0245765 | A1 | 10/2007 | Casher | |

* cited by examiner

*Primary Examiner* — Frederick C Nicolas
(74) *Attorney, Agent, or Firm* — Daniel Boudwin; Global Intellectual Property Agency LLC

(57) ABSTRACT

Disclosed is a beverage pouch or bladder supporting container having a plurality of elements for the purposes of efficiently dispensing, storing and preserving the beverage contained within the pouch, all while presenting an outward appearance that is tasteful and decorative. The container comprises an enclosure having an internal volume and a base, wherein the volume is actively cooled using a refrigeration system or alternatively is insulated for retaining a plurality of freezable blocks or a quantity of ice therein. Along the forward face of the enclosure is an aperture adapted to accept the spout of the beverage pouch, while an attachable or pull-out drip tray is positioned therebelow. Within the interior of the enclosure may further be provided a bladder support element adapted to suspend, compress or elevate the bag for more efficient and constant-flow dispensing of its contents through the externally-mounted spout.

18 Claims, 6 Drawing Sheets

FLUID POUCH DISPENSING CONTAINER, COOLER AND SUPPORT

CROSS REFERENCE TO RELATED APPLICATION

This application claims the benefit of U.S. Provisional Application No. 61/491,414 filed on May 31, 2011, entitled "Wine Tapp." The patent application identified above is incorporated here by reference in its entirety to provide continuity of disclosure.

BACKGROUND OF THE INVENTION

1. Field of the Invention

The present invention relates to beverage dispensing containers, coolers, and mini-refrigeration units. More specifically, the present invention pertains to a beverage pouch or bladder support container, dispenser and drip tray, wherein the container includes internal support elements for the flexible pouch and the container comprises an insulated cooler box, simple support container or a refrigerated container for keeping beverages at an optimum temperature for serving.

It is common during social events, weddings and other gatherings to serve wine and other assorted beverages. Generally this includes opening bottles of wine and other beverage containers and requiring guests to serve themselves or provide a bartender for dispensing drinks to each guest. Opening individual bottles of wine can be troublesome and further lead to quantities of unconsumed wine that quickly spoils. Further, paying for a server or attendant to serve guests can be quite expensive, and is generally reserved for larger or more extravagant events. A common means of dispensing beverages that solves both of these issues, including opening individual bottles and operating with an attendant, includes self-serve dispensers of the coffee or juice type, commonly located along buffet lines or at refreshment tables. These devices allow individuals to choose their desired beverage and manually dispense a desired quantity into a cup or glass via the container spout or spigot, which dispenses fluid from the container interior as the user holds the cup or glass over a drip tray. The present invention contemplates a wine dispenser of a similar type for the purposes of dispensing during events or for use within a residential household.

An issue arising from the use of such self-serve dispensers of the coffee or juice type is the outward appearance and appropriateness of the dispenser during more elegant events, wherein the decorative features of the dispenser may be scrutinized. A further issue relates to the means of storing such beverages within these dispensers. Generally these include an open interior for storing a quantity of a beverage, while the structure includes a means of insulation and a spout for dispensing the liquid from its interior. This structure is well adapted to store coffee for extended periods, but lacks the features that would allow chilled wine to be stored therein. Further, the quantity of wine in each dispenser would require several bottles to be opened to fill the vessel, which would rapidly spoil if left unattended or unconsumed for periods of time.

The present invention is therefore disclosed to advance the art of such dispensers, and in particular a dispenser specifically suited for wine is herein disclosed. Provided is an enclosure having means to efficiently dispense, store and preserve wine, while the enclosure outward appearance may be elegantly designed or be tailored for a specific occasion or theme. The present invention is designed to support and store bladders of wine that are commonly found in wine boxes, which have inherent flaws to their structure when utilized alone or dispensed directly from their associated box.

Wine pouches or bladders are structures generally sold in box enclosures, and comprise flexible sidewalls that support and contain the wine, while a spout is provided for dispensing the wine from the bladder interior. These structures are well known in the art and provide a convenient means of selling and dispensing quantities of wine in a way that allows the structure to be resealed after being opened, allowing the wine to remain fresh longer and further allowing larger quantities of wine to be stored in a single vessel. There are several drawbacks to wine bladders of this type, and generally include their ability to efficiently dispense their entire contents as the bladder nears being empty, and further includes the wine box outward appearance and perceived lack of sophistication when compared to traditional wine bottles. As a bladder of wine draws empty, it is difficult to dispense the remaining portions from the bag without tilting or squeezing the bag to force it through the bladder spout. This requires a user to open a wine box and manipulate the bladder to ensure all wine is dispensed and to avoid large quantities of wasted wine. The secondary drawback related to wine boxes limits their deployment in certain situations, which requires the user to utilize wine bottles, which creates the aforementioned drawbacks related to spoiled and wasted quantities of wine.

2. Description of the Prior Art

Several devices have been disclosed in the prior art that relate to dispensing vessels, including devices that are particularly suited for supporting or insulating a bladder or pouch of wine, or entire wine boxes therein. These devices employ familiar design elements for the purposes of housing a wine bladder or wine box, and further include features to cool or insulate the bladder while positioned therein. These devices, however, lack the novel features of the present invention that allow a bladder to efficiently dispense wine, store the bladder for extended periods and provide an enclosure that is appropriate for formal gatherings or well suited for household use. The following is a list of patented devices and published patent application publications that are particularly relevant to the present disclosure, and are herein described for the purposes of highlighting the novel features of the present invention and the inherent drawbacks of the prior art.

Specifically, U.S. Pat. No. 6,334,329 to Weller discloses a wine box cooling device that comprises a separable housing having a base portion and a cover portion. The base portion is adapted to accept a cooling ice block while the cover portion is adapted to accept and shroud the outer extents of a wine box. The cover portion forms over the base portion to enclose the wine box and ice block, while the spout of the wine box is extended through an aperture formed by two semicircular cut-outs along a shared edge between the two portions. The cover portion further comprises a labeling means to signify the type or style of wine stored within the housing. While the Weller device is related to wine boxes and providing a means to house and cool the same, it is a relatively simple structure that provides cooling for short periods, while its structure is adapted to accept an entire wine box and internal bladder. The present invention provides improved cooling, supporting and dispensing features that advance the art of wine box dispensation over the Weller device. The present invention contemplates supporting an exposed wine box bladder, wherein its internal elements improve cooling, support and efficient dispensation of the bladder contents while positioned within the device.

U.S. Pat. No. 7,464,567 to Crossley is another device that discloses an apparatus for cooling and dispensing wine from a wine-filled bag, wherein the apparatus comprises a box for housing the bag and several embodiments for cooling the bag while therein. A drip reservoir along the front of the box is positioned below the bag spout, while a nameplate is securable above the spout for bag content identification purposes. Similar to the Weller device, the Crossley box comprises two portions that form together around a wine box bag, wherein the spout is positionable though an aperture created by corresponding semi-circular notches in the box section's share forward edge. A freezable liquid pack may be placed within the box, or alternatively the box walls itself may contain freezable panels for cooling the wine bag contents while positioned within the box. Further disclosed is the box having a wedge-shaped interior edge to facilitate tipping of the bag and constant pouring of wine. The Crossley device provides a wine bladder serving box having similar intent of the present invention; however, similar to the Weller device, the Crossley device lacks the novel features that allow the present invention to efficiently cool, dispense and store a wine pouch for serving purposes. The internal support elements and the construction of the enclosure in the present invention diverge from the Crossley device in both spirit and structure.

Further, U.S. Pat. No. 6,658,857 to George discloses a portable thermoelectric cooling and heating appliance for the purposes for storing a liquid in a temperature controlled container. The container comprises a hinged box enclosure having an internal divide for a first and second liquid chamber, while further comprising a sidewall having internal heat and cooling coils therein for cooling or heating the liquid within respective chambers of the device. A first and second spigot is provided along sidewall in opposite to the temperature controls of the heating and cooling elements. A voltage regulator and thermostat are utilized to maintain a desired temperature within the chambers, thereby providing a transportable enclosure for liquid desired to be cooled or heated to a specific temperature, wherein power is provided by a cord attachable to a vehicle or residential electrical outlet. The George device discloses a cooler container of the general, wherein the cooler includes spigots and an internal means of regulating temperature. It is not specifically relate nor suited for the intended uses of the present invention, wherein the present invention provides a novel serving and storing container for beverage pouches.

U.S. Pat. No. 6,269,653 to Katuša is another device that discloses a portable refrigeration device for containerized beverages, wherein the device comprises a receptacle forming a basket, wherein the base of the basket includes a refrigeration unit compartment for cooling the basket contents. The refrigeration unit includes a thermoelectric motor, condenser, evaporator and compressor for creating a cool interior volume within the basket, while the top of the basket is closable using a corresponding lid. While fulfilling a need in the art for a cooled container baskets, the Katuša device lacks the ability to dispense a beverage from its interior, and further diverges in spirit and scope with regard to the present disclosure. The present invention provides a refrigerated container embodiment, however with different structural and support elements within the container for cooling a beverage bladder prior to dispensation.

U.S. Pat. No. 4,812,054 to Kirkendall discloses an insulated carrier for a rectangular wine box having a spigot dispenser. The carrier comprises an insulated housing forming an assemblage of panels that are adapted to surround the wine box and provide a layer of thermal insulation and a means to support the wine box in an upright position. An openable front panel allows the wine box to be positioned thereinto, while the spigot of the wine box is fed through an aperture along the front panel for dispensing its contents while within the carrier. Two attachable handles connect to the side panels and allow the assembly to be supported as a handbag for easy transport. The Kirkendall device provides a unique carrying case for a wine box, wherein transport and thermal insulation is accounted for, and further provided is a means of dispensing the wine from the box while the device is being carried. The present invention relates to a static dispenser that is adapted to provide ready dispensing of wine, cooling and features that facilitate efficient pouring thereof from a wine box bladder. The present invention is adapted to be positioned within a household or deployed during an event to allow ready access to wine from a refrigerated or cooler structure, wherein the structure is one that is not meant for ready transport. The elements of the Kirkendall device differ in structure and scope with regard to the present invention.

Finally, U.S. Pat. No. 4,105,139 to Scholle discloses a fluid dispenser having an outer shell and a fluid-filled flexible bag insert within the outer shell. The spout of the fluid bag is extractable from one end of the shell to allow dispensation of the fluid therefrom while the bag is inserted within the shell interior. In its preferred configuration, the outer shell forms a simulated barrel structure to complement the packaging and service of beverages such as wine. A removable bung within the shell and between the shell and bag is adapted to allow insertion of chilled water or ice for cooling the fluid contents of the bag insert. The Scholle device provides a container forming a shell for housing a wine box pouch or similar fluid bag insert, wherein the spout is extractable through an end of the shell for dispensing the bag contents. The Scholle device further contemplates a barrel shape as the shell structure. The present invention relates to a wine pouch support container having elements that facilitates improved dispensing and maintenance of the wine, while also contemplating decorative shapes and designs for the container itself. The present invention advances the art of beverage support pouch containers beyond the scope of the Scholle device, wherein internal elements are disclosed for ensuring steady flow of liquid and complete emptying of the pouch contents are possible without manually manipulating the bag once it is nearly empty.

The present invention is a wine box bladder enclosure, support and dispensing device that comprises several embodiments for the purposes of offering a new means to dispense wine and preserve its contents over extended periods. The enclosure itself may comprise a simple cooler device, or a refrigerated embodiment, wherein either embodiment includes insulation and a means to maintain a low operating temperature for white wine and other beverages required to be chilled to serve and store. Internally within the enclosure are pouch support elements that provide an even flow of liquid from the bladder, even as its contents are nearly emptied. Further, the outward appearance of the enclosure is one that is well suited for formal occasions, for everyday use within a household or for use outdoors during tailgate or similar activites. In light of the aforementioned prior art devices, it is submitted that the present invention is substantially divergent in design elements from the prior art, and consequently it is clear that there is a need in the art for an improvement to existing beverage pouch support, serving and storage devices. In this regard the instant invention substantially fulfills these needs.

SUMMARY OF THE INVENTION

In view of the foregoing disadvantages inherent in the known types of beverage pouch support, serving and storage devices now present in the prior art, the present invention provides a new enclosure wherein the same can be utilized for providing convenience for the user when dispensing and storing a beverage during a formal event or in everyday use within a household environment.

It is therefore an object of the present invention to provide a new and improved beverage pouch support, serving and storage device that has all of the advantages of the prior art and none of the disadvantages.

It is another object of the present invention to provide an enclosure that is adapted to support a bladder or pouch of fluid having a spout and a means to extend the spout through an enclosure wall for dispensing thereof, wherein the enclosure provides several elements for supporting the bladder and ensuring efficient and even dispensing of fluid therefrom.

Another object of the present invention is to provide a fluid bladder enclosure that is provided in two embodiments: a cooler type enclosure that is adapted to accept cooling bricks or a quantity of ice, and a refrigerated enclosure adapted to actively cool the interior of the enclosure using a refrigeration cycle and electrical power.

Another object of the present invention is to provide a wine serving enclosure that is both decorative and appropriate for the given environment, and one that is well suited for dispensing and storing large quantities of wine or similar beverages from a pouch in a self-serve manner.

Yet another object of the present invention is to provide a wine serving enclosure that may include several outwardly decorative forms, wherein the novel support elements of the present invention may be employed in a number of different situations, including formal gatherings, outdoor events or alternatively for daily household use.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
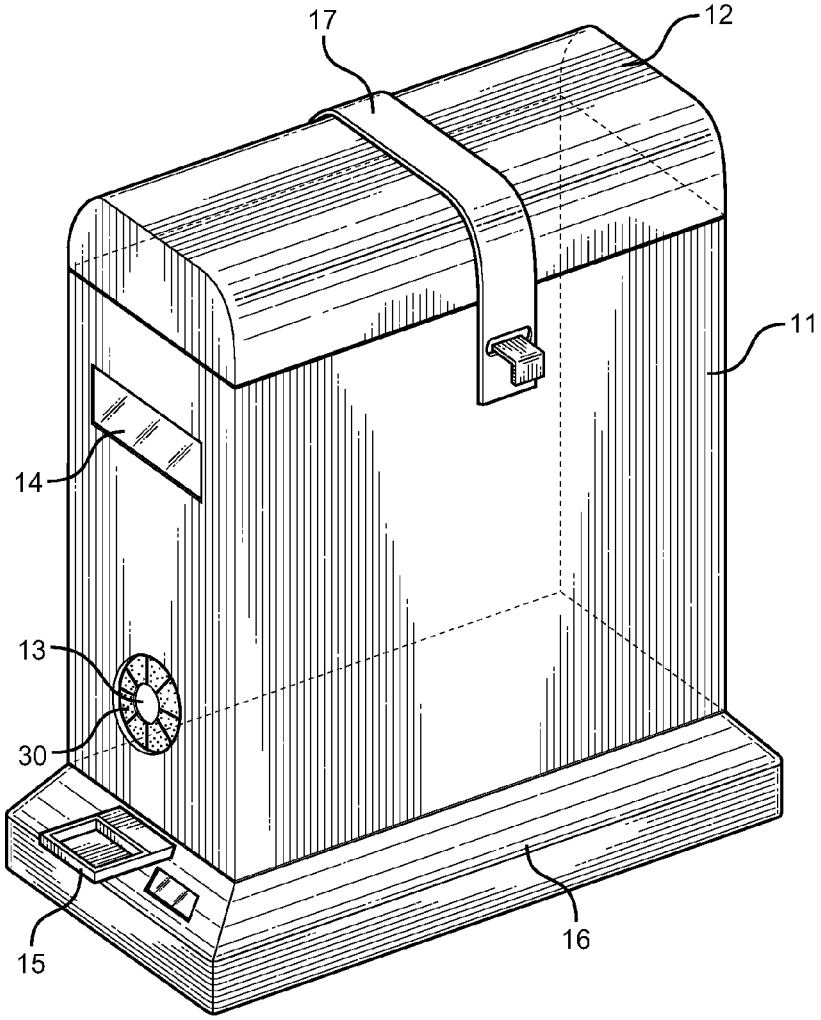
FIG. 1 is an overhead perspective of the liquid pouch support enclosure of the present invention.

Reference is made herein to the attached drawings. Like reference numerals are used throughout the drawings to depict like or similar elements of the beverage pouch support, serving and storage device. For the purposes of presenting a brief and clear description of the present invention, the preferred embodiment will be discussed as used for supporting, storing and serving liquid from a pouch using a tasteful and event-appropriate enclosure. The figures are intended for representative purposes only and should not be considered to be limiting in any respect.

Referring now to FIG. 1, there is shown an overhead perspective view of the wine pouch enclosure of the present invention. The enclosure comprises a housing 11 having a hollow interior, a base 16 and a securable opening 12 that allows access to the housing interior. Along the forward face of the housing 11 is an aperture 13 adapted to accept the spout of a wine box bladder, which fits therethrough when the pouch is positioned within the housing interior. The aperture may include a gasket element 30 that snugly fits about the neck region of the pouch spout, keeping the spout in stable position while a user draws liquid therefrom. A drip tray 15 is positioned below the aperture 13 to accept quantities of spilt liquid from the spout. The drip tray 15 may either be statically positioned along the housing, or optionally retractable into the housing interior and slideable therefrom. Further provided along the forward face of the housing is a location for mounting a nameplate 14, logo or indicia, wherein the type of wine or beverage housed within the enclosure may be displayed for notifying users serving themselves from the pouch spout.

The outward appearance of the enclosure and the location of the opening 12 is one that may be provided in varying embodiments, depending on the desired design details for the particular intended use thereof, wherein the styling and structure of the enclosure can be purchased to suit a particular event or for household use. To aid deploying the device, a carrying strap 17 mounted over the top of the housing 11 may further be provided to allow a user to carry the assembly to a serving station, whereafter it can be replaced or removed when an emptied interior liquid pouch needs to be replaced.

Figure 2:
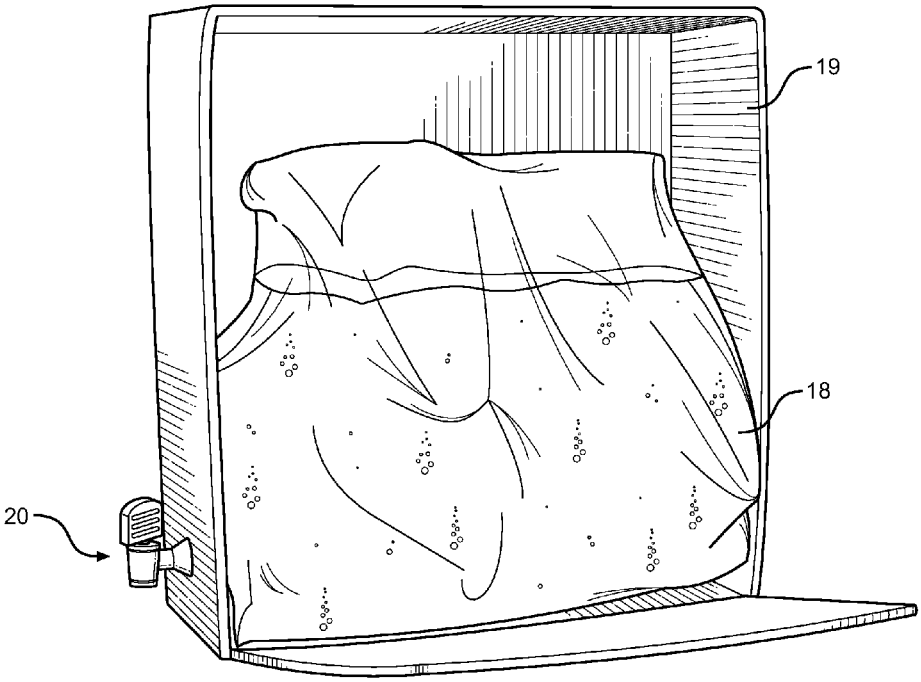
FIG. 2 PRIOR ART
FIG. 2 is a view of a typical wine box and its internal liquid pouch.

Referring now to FIG. 2, there is shown an internal view of a typical wine box assembly, wherein a sidewall of the wine box structure is opened to reveal a liquid bladder 18 of the type contemplated for use with the present invention. Typical wine boxes comprise of a hollow, rectangular structure 18 that houses an internal bladder 18 of wine. A spout 20 is positioned through an end wall of the box 19 that is attached to the bladder 18, which operably allows the communication of fluid from the bladder 18 and into a user's glass therebelow. These assemblies are well known in the art, and have several inherent drawbacks that are addressed by elements of the present invention. Most notably, the box 19 is one that merely shrouds the bladder 18 and provides little to no means of insulation or cooling, which is of particular importance for white wines that must be refrigerated after opening. Further, the bladder 18 of the assembly is left unsupported within the box 19, with only the sidewalls of the box 19 and the pressure of the bladder fluid thereagainst being utilized to support the bladder 18 in an upright configuration. Therefore, as the fluid level in the bladder is reduced, this pressure is reduced, allowing the bladder to collapse onto itself. As the bladder nears empty, folds in the bladder prevent even flow of fluid through the spout 20. This makes it necessary for the user to tilt the box 19, or even open the box 19 and compress the bladder 18 to force the remaining fluid therefrom. This is a very inefficient means of drawing the fluid from the bladder 18, and often results in residual quantities of liquid within the bladder that goes to waste as a result.

Figure 3:
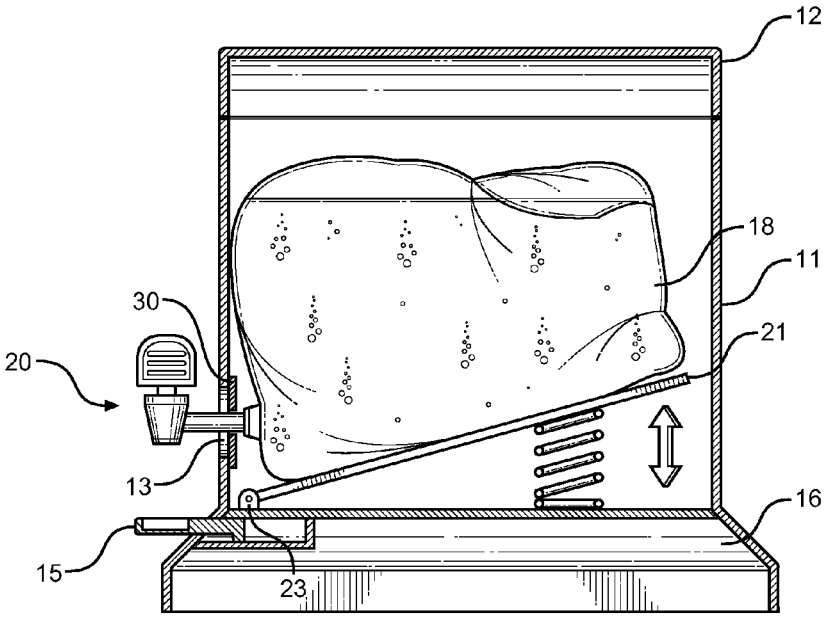
FIG. 3 is a cross section view of the present invention, wherein the elevated platform support is shown.

The present invention contemplates the use of several bladder support elements within the interior of the enclosure that address these known drawbacks to wine boxes and unsupported bladders. Referring now to FIG. 3, there is shown a cross sectional side view of the present invention in a working position, wherein a bladder of wine 18 is mounted within the interior of the housing 11 and its spout 20 is positioned through the aperture 13 in the housing forward face. In this embodiment of the present invention, the bladder 18 is supported by an angled surface 21 that tilts the bladder towards its spout 20 for the purposes of efficiently draining the entire bladder 18. The angled surface 21 is supported by a rotatable hinge at one end, and a spring element towards its second end and thereunder, which applies a progressive or liner force on the base of the surface 21 to change the tilt angle to a greater angle with respect to the housing base 16. As the bladder 18 empties, it becomes lighter, and thus the spring forces the plate 21 higher and draws more fluid towards the spout end of the bag and prevents liquid from being trapped within pockets or folds as the bladder shrinks and folds onto itself while emptying. The hinge of the plate 21 is positioned towards the forward face of the housing, while the spring is mounted towards its back surface, whereby the spring force tilts the fluid towards the pouch spout 20 mounted through the front face aperture 13. This tilting mechanism is of particular importance if less viscous fluid is being delivered through the spout 20, for instance frozen beverages or smoothies, which are not as actively flowing as wine or similar fluids.

The base 16 of the enclosure is either a solid or hollow member that is permanently or removably attached to the housing 11, and can be utilized to store the refrigeration elements of the assembly or be utilized as a weighted mass to prevent tipping of the assembly while in use. To this end, it is contemplated that the present invention be separated into two primary embodiments: a cooler style enclosure and a refrigerated enclosure. In the cooler style enclosure, the walls of the housing 11 are insulated and the interior portion is adapted to accept a quantity of ice cubes if required, whereby the pouch contents are served in a chilled state. The base may remain hollow to accept a frozen ice block, or further it may be a solid structure. Ice is poured into the housing interior via the lid opening 12, whereby the pouch 18 is chilled while the walls of the housing prevent heat transfer and rapid melting of the ice. In a refrigerated embodiment, the enclosure is a miniature fridge device that actively cools the pouch using a gas phase change process or similar refrigeration cycle, wherein a compressor, evaporator coils, condenser coils and elements that facilitate the refrigeration cycle are provided within the housing 11 or within the base 16 thereof. This embodiment requires electrical power and thus a cord that accepts outlet power or an internal battery pack. It is not desired to limit the present invention to given refrigeration design, but rather it is desired to disclose an embodiment that utilizes a well known and described cooling process that is readily recognizable and designable for the disclosed application by one skilled in the art.

Figure 4:
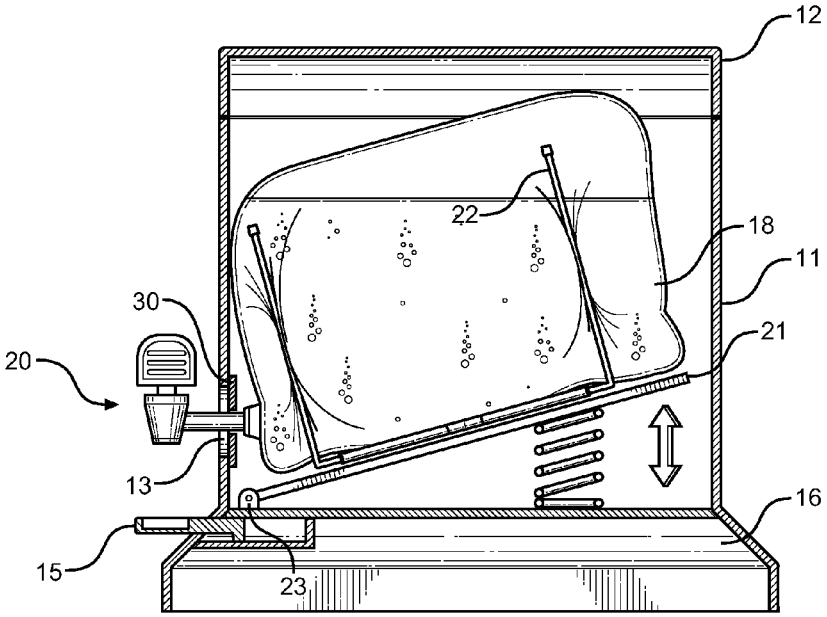
FIG. 4 is a cross section view of the present invention, wherein the elevated platform support and pouch compression element is shown.

Referring now to FIG. 4, there is shown another cross sectional side view of the present invention, wherein another internal bladder 18 support element is shown facilitating constant flow of fluid from the bladder. In this embodiment, a bladder compression element 22 is positioned within the housing 11 and around the installed bladder 18. The compression element 22 comprises a spring-loaded member that squeeze the bladder from both of its sides, maintaining the fluid pressure on the bladder 18 walls as the fluid level reduces. This ensures a constant flow of fluid through the spout 20 as the fluid level depletes, and eliminates the need for a user to open 12 the enclosure and manually squeeze or otherwise manipulate the bladder 18 to extract the remaining fluid therefrom. The compression element 22 may be utilized in conjunction with the angle surface 21, or by itself within the housing 11 interior. When utilized together, the two elements act to maintain continuity of flow from the bladder as it draws empty, and further ensures nearly all fluid will be extracted therefrom before requiring a replacement bladder.

Positioned below the bladder spout 20, which is fed through an aperture 13 along the forward face of the enclosure and preferably secured by an elastomeric grommet, is a static or retractable drip tray 15. The drip tray 15 is adapted to catch spilt fluid from the spout 20 that does not enter a user's glass or cup. The tray 15 comprises a reservoir having upstanding sidewalls to collect a volume of fluid. Its attachment to the enclosure may comprise a static connection that is removable, or one that incorporates a slide mechanism for sliding and retracting the drip tray from within the enclosure base 16. In this way, the tray 15 may be positioned within the base 16 when not in use, and then deployed when a bladder 18 is inserted within the housing 11 and the assembly is ready to begin dispensing.

Figure 5:
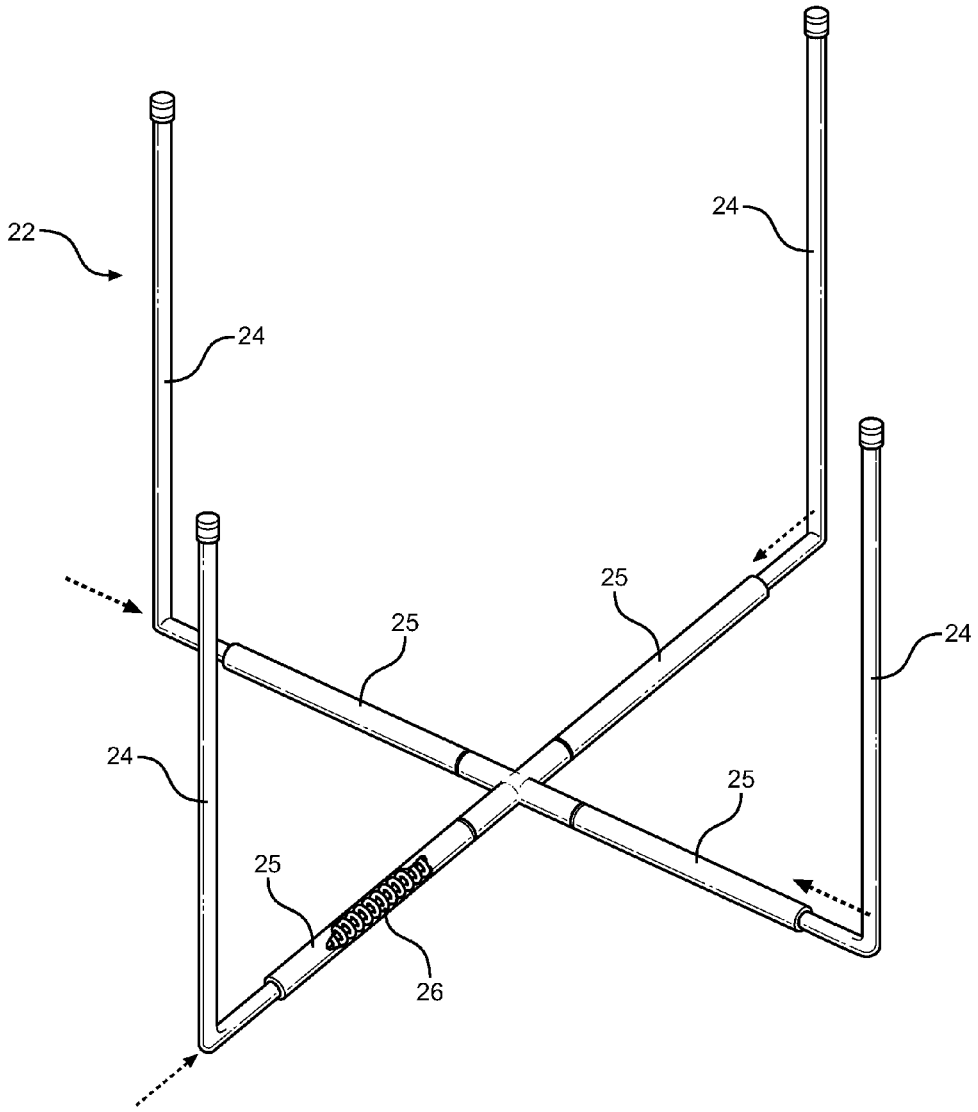
FIG. 5 is a perspective view of the internal pouch compression element of the present invention.

Referring now to FIG. 5, there is shown an overhead perspective view of the bladder compression element 22 of the present invention. The compression element 22 is one that is adapted to secure around the sidewalls of a bladder and apply an inwardly compressive force thereon. The compression is balanced on opposing sides to exert a pressure on the sealed bag, which increases the fluid pressure on the bladder sidewalls and thus the exiting pressure of the fluid through the bladder spout. As the bladder fluid level decreases, the compression element 22 maintains a sufficient fluid pressure to allow constant dispensation through the spout, avoiding any manual manipulation of the bladder prior to replacement. The element 22 comprises a plurality of upstanding posts 24 that are adapted to be positioned against opposing sidewalls of a bladder. The posts 24 are slideably connected to a central base having post connecting chutes 25. Internal spring mechanism 26 draw the posts inward, into the chutes 25 with a constant or progressive force, which allows the upstanding portion of each post 24 to apply pressure to a bladder positioned therebetween. The posts employ an upstanding and a lower portion, forming an L-shape. The lower portion is drawn into the base in a telescopic manner via spring mechanisms 26, facilitating a pressure on the bladder.

Figure 6:
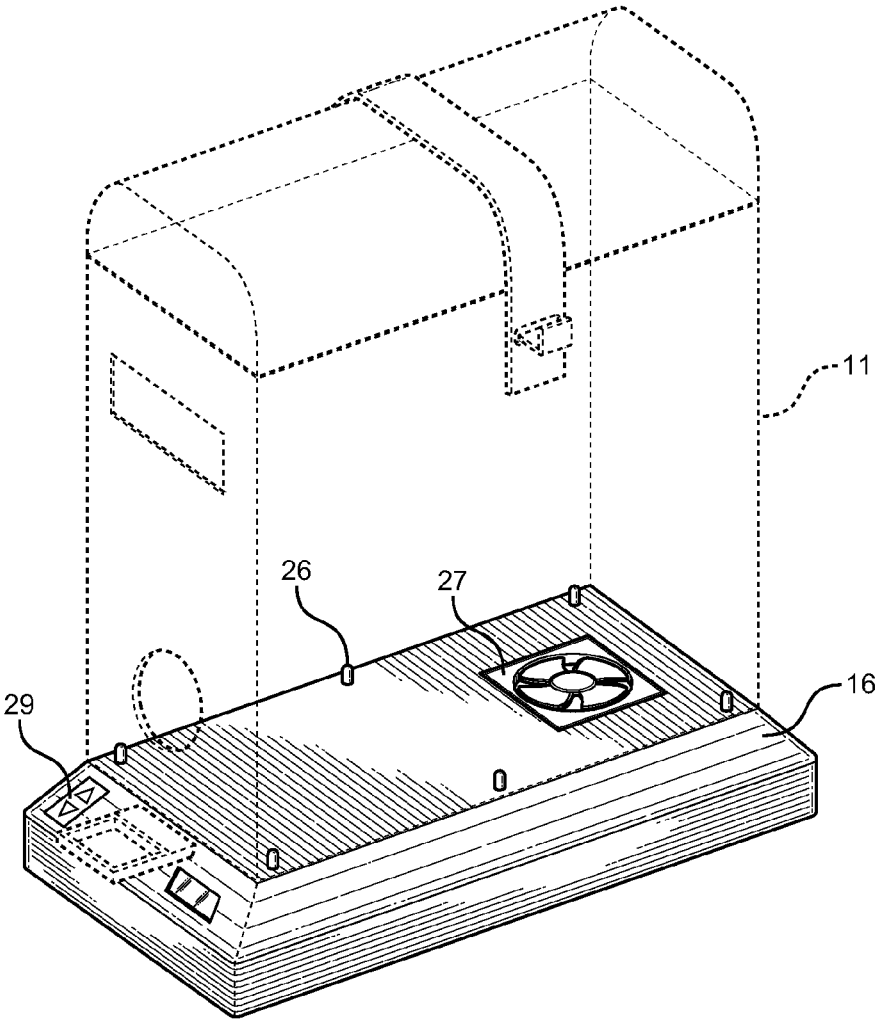
FIG. 6 shows an embodiment of the present invention, wherein a refrigeration unit is situated within the base of the enclosure and the upper portion of the enclosure is removable.

Referring now to FIG. 6, there is shown an embodiment of the present invention that contemplates the inclusion of a refrigeration cycle for means of cooling the interior of the housing 11. Further shown in this figure is an embodiment that contemplates an enclosure having a removable housing 11 and base 16, wherein the base 16 is an enclosed unit that is separable from the housing 11. The present invention contemplates the use of a refrigeration as a means of cooling the bladder contents, or alternatively the enclosure may be provided as a cooler-type device, wherein no active cooling elements are provided and the interior is adapted to accept a quantity of ice or frozen blocks and the housing sidewalls include thermal insulation. For the refrigerated embodiment, the refrigeration elements may be stored in the base 16 of the enclosure, wherein refrigerant is pressurized and condensed to create cold air, which may enter the housing or be blown therein via a fan 27. Temperature controls 29 along the forward portion of the base 16 allow the interior environment to be controlled by the user, whereby the contents of the bladder are not frozen or maintained at an elevated temperature that could lead to spoilage. Power for the refrigeration elements comes in the form of an electric cord extending from the housing or in the form of an internal power supply, such as a battery pack. When used indoors and in proximity to an electrical outlet, the electrical cord draws alternating current from the fixture for power. When outdoors it is contemplated that the cord may draw power directly from a car outlet or tailgate outlet, providing power when tailgating or engaging in outdoor activities in close proximity to a vehicle or generator.

Figure 7:
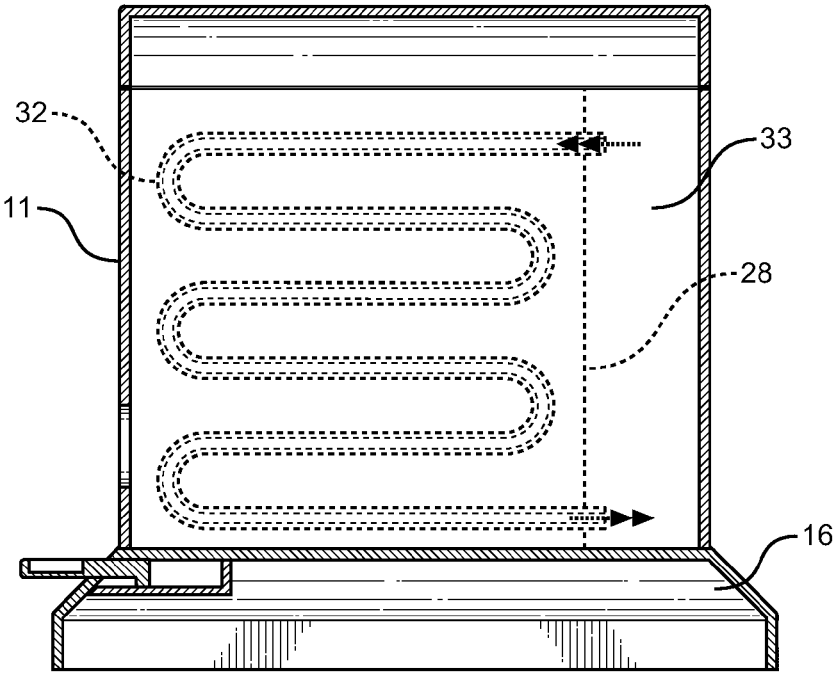
FIG. 7 shows another embodiment of the present invention, wherein the enclosure upper portion is segmented to house the refrigeration elements, and evaporator coils are positioned within the enclosure sidewalls.

Structurally, the enclosure may include a removable housing embodiment, which includes guide tabs 26 or other suitable attachment means for connecting the base 16 to the housing 11. The two members are securable together to allow the assembly to be carried via the housing strap without separation. Referring now to FIG. 7, there is shown a design of the refrigeration embodiment that includes evaporator coils 32 within the sidewalls of the housing 11, which allows cool air to be generated via the evaporative phase change of refrigerant and dispensed throughout the housing from its sidewalls. Also shown in FIG. 7 is a design of the housing 11 that includes an interior section 28 that separates the interior volume into the bladder area and an area for positioning the refrigerating elements. It is not desired to limit the design of the housing and base to a particular setup or layout, but rather it is desired to disclose several embodiments that utilize the bladder support elements and a means to house and cool its contents in a variety of foreseeable environments.

The present invention comprises a wine or beverage bladder support, dispenser and cooling device, wherein a bladder is supported within an enclosure and maintained at a desired temperature. Internal support elements within the enclosure allow uniform draining of the bladder contents as the bag fluid level drops, while the temperature thereof is regulated via a refrigeration cycle, a quantity of ice and the thermal insulation provided by the sidewalls of the enclosure. The present invention, therefore, is directed to a liquid bladder enclosure that includes a means of cooling, support and dispensing of the bladder contents that advances the art of such devices without limiting its deployment or the environment in which the elements of the present invention may be utilized. The refrigerating elements may be positioned within the base 16 of the enclosure or within its upper housing 11, or alternatively be absent in favor of a simpler, thermally insulated cooler enclosure adapted to accept cooling blocks or ice therein. The support elements may comprise an elevated and sprung platform that tips the bladder forward, and further a bladder compression element that applies a load to the sidewalls of the bladder. Both of these elements may be included, or independently utilized for the purposes of creating a steady flow of fluid without user manipulation of the bladder within the enclosure. The opening for the housing may further be positioned along the top, front, rear or sidewalls of the device, or further the housing itself may be separable from the base to allow the bladder to be supported.

Multiple configurations and designs are contemplated, falling within the scope and spirit of the present disclosure. Further, the outward appearance of the enclosure is one that may be tailored to meet a specific requirement, such as a formal event or one that addresses consistent use in a household environment. The ornamental features and shape of the enclosure is one that may be readily modified, including different materials, geometry and styles. In one exemplary embodiment, the enclosure may be formed of a wine barrel shape having a base. In another embodiment, the housing may be rectangular structure having a base. It is desired to disclose a pouch supporting and dispensing enclosure that is suitable for formal or informal gatherings, wherein its novel elements are utilized over opening individual wine bottles or hiring a bartender to serve each guest.

In light of the present disclosure and the aforementioned prior art, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A liquid bladder support, serving and storage device, comprising:

an enclosure having a housing and a base, said housing having an interior volume and said base supporting said housing;

said housing interior adapted to hold a liquid bladder therein;

said housing having a forward surface comprising an aperture adapted to accept a liquid bladder spout therethrough;

said housing having a bladder support element comprising an angled support surface under said bladder;

said angled surface being hinged at one end and being elevated via a spring element at a second end, wherein said surface angled to tilt said bladder toward said forward face.

2. The device of claim 1, wherein said enclosure further comprises insulated sidewalls and an interior adapted to accept a quantity of ice therein for cooling said bladder fluid.

3. The device of claim 1, wherein said housing further a bladder support element comprising a bladder compression element adapted to apply an inward compressive force on said bladder sidewalls.

4. The device of claim 1, wherein said enclosure further comprises an open base adapted to accept frozen ice blocks for cooling said bladder fluid.

5. The device of claim 1, wherein said enclosure further comprises elements that achieve a refrigeration cycle for cooling said bladder fluid.

6. The device of claim 1, wherein said enclosure further comprises a drip tray positioned below said forward face aperture.

7. The device of claim 6, wherein said drip tray is retractable within said enclosure.

8. The device of claim 1, wherein said housing is separable from said base for accessing said housing interior.

9. The device of claim 1, wherein said housing further comprises a securable and openable lid for accessing said housing interior.

10. A liquid bladder support, serving and storage device, comprising:

an enclosure having a housing and a base, said housing having an interior volume and said base supporting said housing;

said housing interior adapted to hold a liquid bladder therein;

said housing having a forward surface comprising an aperture adapted to accept a liquid bladder spout therethrough;

said housing having a bladder support element comprising a bladder compression element adapted to apply an inward compressive force on said bladder sidewalls;

a plurality of upstanding posts having an upstanding portion and a lower portion forming a L-shape;

said post lower portions slideably connecting to a central base;

said post lower portions drawn towards said base via a spring mechanism that applies an inward force to said posts.

11. The device of claim 10, wherein said enclosure further comprises insulated sidewalls and an interior adapted to accept a quantity of ice therein for cooling said bladder fluid.

12. The device of claim 10, wherein said enclosure further comprises an open base adapted to accept frozen ice blocks for cooling said bladder fluid.

13. The device of claim 10, wherein said enclosure further comprises elements that achieve a refrigeration cycle for cooling said bladder fluid.

14. The device of claim 10, wherein said enclosure further comprises a drip tray positioned below said forward face aperture.

15. The device of claim 14, wherein said drip tray is retractable within said enclosure.

16. The device of claim 10, wherein said housing is separable from said base for accessing said housing interior.

17. The device of claim 10, wherein said housing further comprises a securable and openable lid for accessing said housing interior.

18. A liquid bladder support, serving and storage device, comprising:

an enclosure having a housing and a base, said housing having an interior volume and said base supporting said housing;

said housing interior adapted to hold a liquid bladder therein;

said housing having a forward surface comprising an aperture adapted to accept a liquid bladder spout therethrough;

said housing having a bladder support element comprising a bladder compression element adapted to apply an inward compressive force on said bladder sidewalls;

said bladder support element further comprising an angled support surface under said bladder; and said angled support surface being hinged at one end and being elevated via a spring element at a second end, wherein said surface angled to tilt said bladder toward said forward face.

* * * * *